US005509572A

United States Patent [19]

Curtis

[11] Patent Number: 5,509,572

[45] Date of Patent: Apr. 23, 1996

[54] SELF SERVICE PICK UP AND DROP OFF MACHINE

[76] Inventor: J. Edward Curtis, Allans Mills, IRR4, Marmora, Ont, Canada, K9K 2M0

[21] Appl. No.: 393,923

[22] Filed: Feb. 21, 1995

[51] Int. Cl.[6] ..... G07F 11/00

[52] U.S. Cl. ..... 221/76; 198/411; 414/268

[58] Field of Search ..... 221/69, 76, 9, 221/13, 277; 198/375, 411, 416, 680, 345.3; 414/266, 268, 754

[56] References Cited

U.S. PATENT DOCUMENTS 4,626,160 12/1986 Shiomi et al. ..... 198/345.3

4,717,305 1/1988 Edwards ..... 198/411

*Primary Examiner*—Kenneth Noland

*Attorney, Agent, or Firm*—Richard J. Hicks

[57] ABSTRACT

An integrated self service package pick up and drop off system which is particularly suitable for retail dry cleaning operations is described. A fully enclosed cabinet contains a customer drop off chute, and a customer pick up door which are computer controlled in response to customer signals. Inside the cabinet, which can be entered only by an authorized attendant, to remove dropped off orders and load complete orders, there is provided a motorized gantry system which can select and remove an individual customers order from bar coded storage rails and transport the order down the central aisle to the customer pickup point for removal from the cabinet.

11 Claims, 4 Drawing Sheets

SELF SERVICE PICK UP AND DROP OFF MACHINE

FIELD OF INVENTION

This invention relates to an apparatus for storing a plurality of articles which can dispense or deliver the same in any desired order or sequence in response to an authorized request. Note particularly, this invention relates to an apparatus for receiving, storing and dispensing articles of clothing and the like, in response to a signal generated by the customer or other authorized user of the system.

BACKGROUND OF INVENTION

Self-service pick up, storage and drop off systems for dry cleaning and laundry operations, suitable for use in public locations such as shopping centres, malls and the like are well known in the art. Attention is directed, for example, to an apparatus described in U.S. Pat. No. 4,717,305 issued Jan. 5, 1988 to John D. Edwards. In this device, dry-cleaned garments are stored on hangers on two parallel rails in specifically assigned positions coded to each customer. In response to an authorized request from the customer a carriage is driven along the rails to the customer's specific location where it there lifts an individual loop fixture with the selected garment off the storage rack and delivers it to a customer pick up station where it can be retrieved by the customer. The carriage also includes a controlled device whereby the selected garment is rotated through 90° from its storage position to a conveying and reception position so that it is delivered edgewise to the customer through a very narrow pick up door, thereby reducing the risk of theft of other customers garments. Systems of this type are useful not only for retail dry cleaning and laundry operations, but also for uniform or customer issue and control in such institutions as hospitals, hotels, airlines, factories, film and television studios, theatres for the dramatic arts and the like.

While it is known that retail dry cleaning and laundry operations can increase their markets substantially by having a plurality of convenient pick up and drop off locations, staffed about 10 hours a day, wage and floor space expenses frequently make such operations either marginal or, at worst, unprofitable. Attempts by dry cleaners to provide automated pick up and drop off points, similar in concept to Automated Bank Teller Machines have so far been largely unsuccessful due to the high cost of specialized automation, and customer resistance to the generally unreliable operation of the complex mechanical devices produced to date.

There is a need, therefore, for a practical self service automated pick up and drop off machine which incorporates at least the following features:

(a) a means to identify existing and potential customers such as an electronic card reader or keypad;

(b) a means to communicate to the customer various choices and information such as a visual display;

(c) a means acceptable to customers to make selections and communicate to the system such as a keyboard with two or more buttons, or a touch sensitive screen;

(d) a means to store and physically locate and safely transport the correct package of garments to the customer while securing the machine and its remaining contents from unauthorized or malicious actions;

(e) a means to receive and store garments customers wish to deliver to the machine;

(f) a means to allow the caretaker of the machine to place and identify garments or packages for issue to customers, and to retrieve packages or garments left by customers;

(g) a means to receive, store, validate, calculate, and report information, and in addition to create and interpret signals, and coordinate and control devices such as motors and solenoids.

OBJECT OF INVENTION

An object of the present invention is to provide an integrated self service package pick up and drop off system which is user friendly, mechanically reliable, and which can be computer controlled either on site or from a remote location.

BRIEF STATEMENT OF INVENTION

By one aspect of this invention there is provided a self service apparatus for receiving, storing and dispensing articles in response to signals generated by an authorized user, comprising enclosure means for securely storing said articles and provided with a signal activated drop off access means, caretaker access means, signal activated article pick up means, and user activated signally means; drive means to move said pick up access means between a fully closed to a fully open position in response to signals generated by said user and including means to sense an obstruction in said pick up access means; first parallel rail means mounted in said enclosure means each provided with a plurality of storage locations at which articles ready for delivery to a user may be suspended in planes normal to the direction of the rails; gantry means mounted for movement along said first parallel rail means; carriage means mounted on said gantry means for movement between opposed said first parallel rails; said gantry means and said carriage means being arranged so that said carriage means may select, pick up and convey a selected article from any selected storage location to said article pick up access means in said plane normal to the direction of the rails in response to a signal generated by said authorized user.

DETAILED DESCRIPTION OF PREFERRED EMBODIMENT

Figure 1:
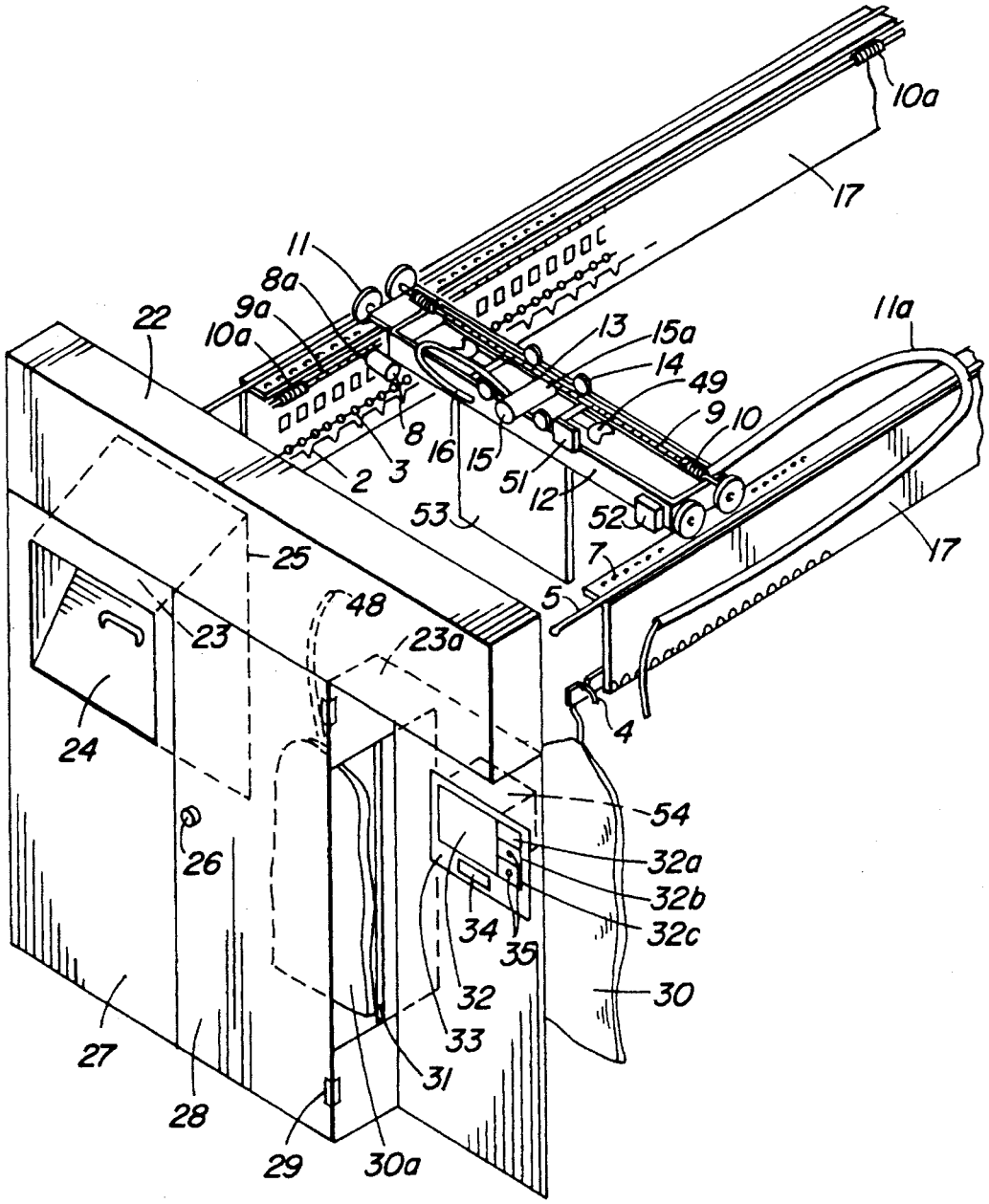
FIG. 1 is a perspective view of one embodiment of a device according to the present invention.

Referring to the drawings, the machine is intended for the automated receipt of and dispensing of parcels hanging from hooks such as coat hangers, and the receipt of parcels such as garments. Referring first to FIG. 1, which is a representation of a complete apparatus, including an improved garment issue mechanism and a novel enclosure.

An attractive, secure front is a basic requirement of any self-service machine. The enclosure shown contains features to make use of the machine safe and easy for users, and secure from malicious or unauthorized acts. It conserves floor space, and may be installed in contained areas since entry by the caretaker is gained from the front. The lighted sign panel 22 is constructed such that light falls down upon the chute at 23, the customer interface at 23*a*, and the garment parcel 30*a* for the users' benefit and security. Chute panel 27 is constructed with baffles 25 to prevent access to the interior when the chute bucket 24 is open. Chute 24 operates much like a mail chute, except for the inclusion of an electronic lock and sensors (not shown) to control access to the chute, and to signal the chute open, and to count or identify parcels. The caretaker access door 28 hinges at 29 and locks 26 such that the door 28 cannot be opened or removed even when customer access door 31 is open. Door 31 slides toward the back of the machine after the gantry panel 53 has blocked the delivery area. In alternative embodiments, the parcel may be negotiated past a fixed barrier, or a separate moving barrier. The opening revealed when door 31 is open as shown is wide enough to allow receipt of a package 30*a* by a customer, but is too narrow for a person to gain entry. Typically the opening is 6 inches wide. If chute bucket 24 or doors 28 or 31 are not properly closed as required, appropriate signals may be sent to a supervisory terminal and registered in the computer event log.

Figure 4:
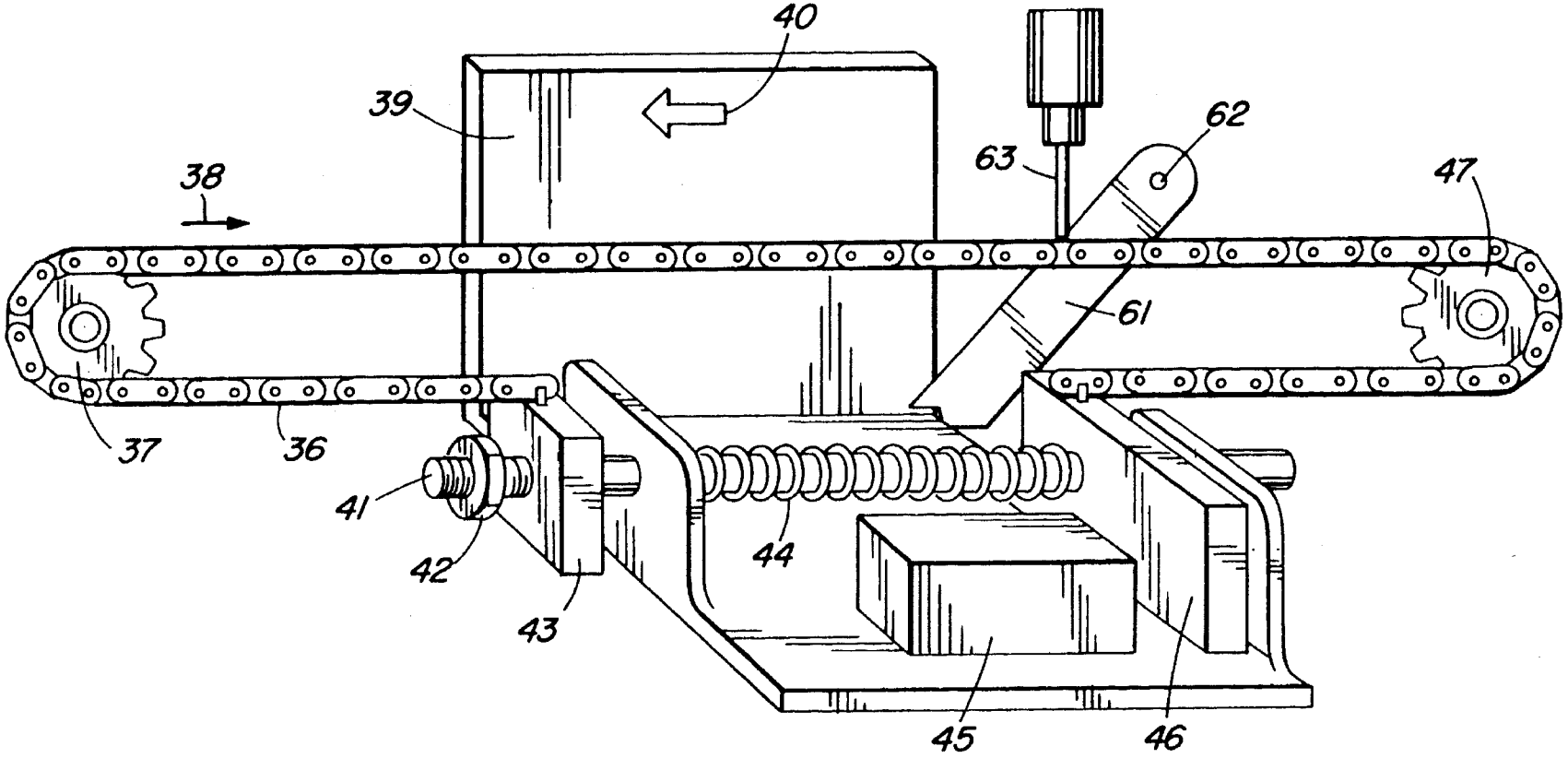
FIG. 4 is a fragmentary perspective view of the door drive and resistance sensing device.

Referring briefly to FIG. 4, there is illustrated a means to move a sliding door or like item, while sensing resistance against the desired movement. This device is used to drive the sliding door (31, FIG. 1) and to sense obstruction when door 31 is closing. The ends of a loop of roller chain, cable or like material 36 is suspended between two or more pulleys 47, 37 are fixed to blocks 43 and 46. When driven in direction 38 the chain 36 will drive the body 39 in direction 40. Tension on spring 44 is adjusted by nut 42 which moves block 43 along the shaft 41. Shaft 41 is fixed to block 46, but is free to slide in the holes in body 39 thus block 46 will move against sensor 45 if the force necessary to move body 39 sufficiently compresses the spring 44. As a fail-safe measure, the door may be pushed back manually even when the motor is powered. Hence a bar 61 pivoting at 62 passively falls into place as shown such that the body 39 cannot be moved. When desired, upwards activation at 63 frees the body to permit door movement.

Returning to FIG. 1, communication with the user is provided by panel 33. Behind the transparent area 32 is a visual display 54. The panel is decorated with stripes at 32*a*, *b*, *c*, and stripes 32*b* and 32*a* are fitted with push buttons 35. When a user is shown a question the proposed answers are displayed in a manner matching the decorated stripes beside the areas 32*b* and 32*c*. Thus it is intuitively obvious which button to press to select a response—a required feature of the invention which may employ multiple language choices. More graphics and more buttons may be mounted as convenient at the boundaries of the display area 32, and similar functionality may be provided by the use of a touch sensitive display commonly available, however the preferred arrangement described is most cost effective. An input device 34 identifies the user. Commonly available electronic card readers or numeric keypads may be used. Additional transparent areas may be provided in panel 33 for instructions, promotions or price lists which are placed behind said panel.

In a preferred embodiment, a customer simply swipes a credit card, such as a Visa card through input device 34, and the account number thereof may be used to identify the customer. If the customer is already in the system, the screen may then ask whether the customer is depositing an article or seeking to retrieve a completed order. If the customer is not in the system, the screen asks whether the customer wishes to open an account and/or purchase a deposit bag which may be automatically coded with the customer's identifying code. If the customer wishes to deposit an order for cleaning, the appropriate button is pushed so as to release the drop off chute 24, as described above. The customer drop off transaction is automatically recorded on the computer and the customer bag can be retrieved by the caretaker on the next routine visit (usually daily, or, perhaps, even hourly), for transport to the central cleaning or other processing plant. If the customer wishes to retrieve a previously placed order, the computer scans the list of completed orders to determine whether the order is complete and available, and if so, activates the retrieval device, as described in more detail hereinbelow and opens the customer retrieval door 31, and at the same time billing the charges to the customer's credit card.

The improved garment storage and retrieval apparatus as shown behind the enclosure in FIG. 1 can hold a multiplicity of garment packages 30 each comprising one or more wire coat hangers 4 located in regularly spaced notches 2,3 in the specially formed rails 17.

Figure 2:
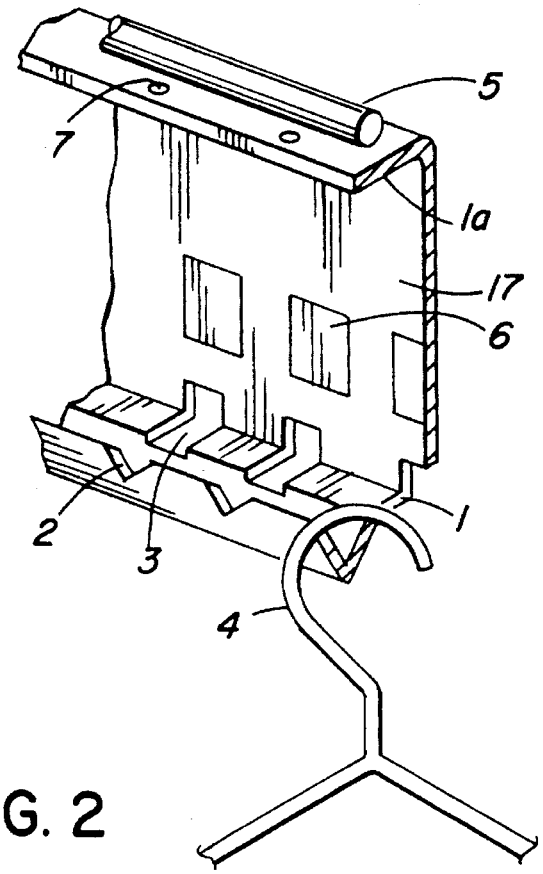
FIG. 2 is an enlarged fragmentary view of a cross section of the hanger rail.

Referring now to FIG. 2, it may be seen that the cross section profile of each rail 17 is formed by four bends, resulting in a channel shape with an offset narrow vee-shaped trough 1 and a straight flange 1*a*. Integral to the top flange 1*a* is a rod shaped track 5, and a plurality of timing holes 7 each of which is related to a notch 2 and hole 3 and identified by a sequential barcode 6, thus providing and identifying a plurality of storage positions for a coat hanger 4 or other hook. As many hooks 4, as will fit through a given hole 3 and notch 2 may be stored at each location. A leg structure (not shown) supports the rails.

Figure 3:
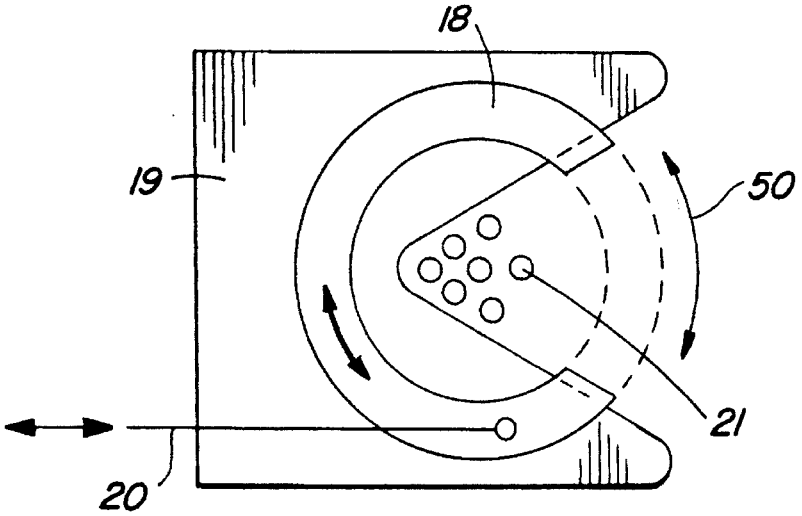
FIG. 3 is an enlarged fragmentary top view of the gripper mechanism.

Referring now to FIG. 3, the wide, tapered mouth 50 of the gripper body 19 permits self alignment over hangers 21 as the body is pushed over such hangers as oriented by the rails previously described. A split ring 18 is retained in an annular groove in the body 19, is rotated as indicated by dotted lines at 50, to capture the hangers 21 by a force applied at 20.

Figure 5:
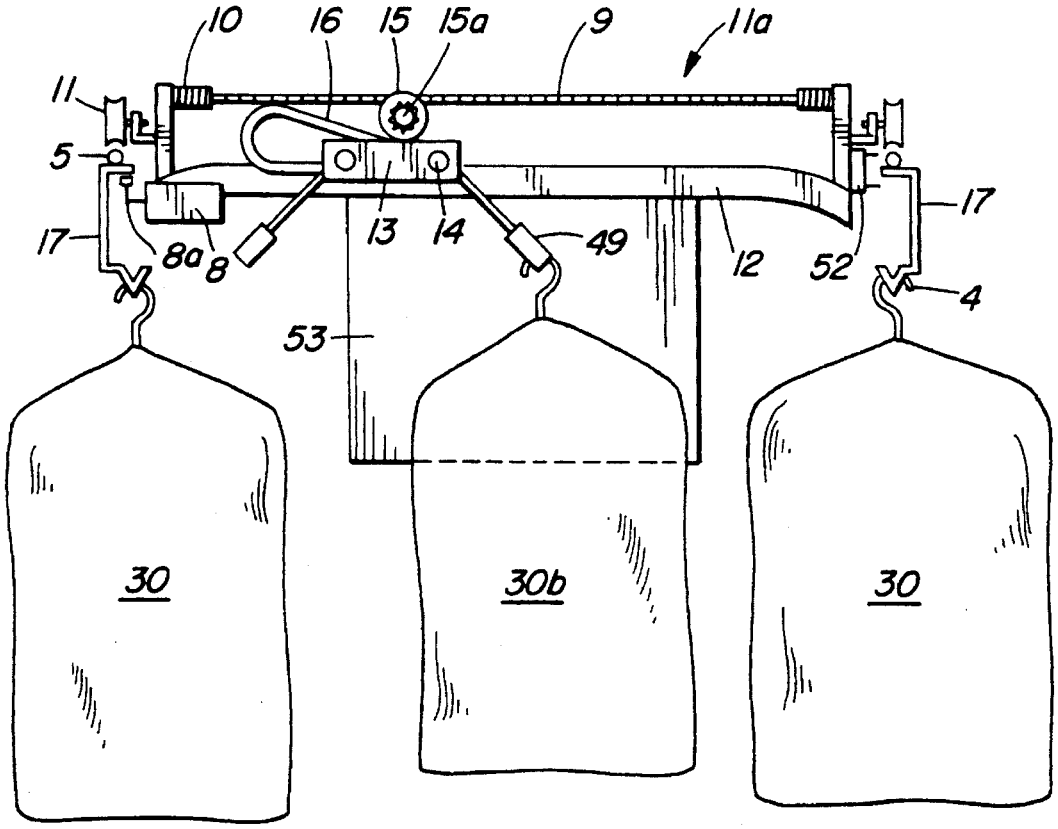
FIG. 5 is a front view of the gantry carriage and rails showing garment parcels.

With further reference to FIG. 1, and FIG. 5 for clarification as required, once enclosed, the hangers are controlled such that the entire package may be lifted directly from the notches 2,3 and moved into the aisle between the two rows of packages 30 for broadside travel (as depicted at 30*b*, FIG. 5) to the customer reception area. This entails the use of a gantry carriage arrangement 11*a* as is well known in many material handling applications. In the preferred and improved embodiment, the carriage body 12 is supported by wheels 11 which ride rails 5 providing access to all storage positions and the reception area. Motor 8 with sprocket 8*a* is mounted to the carriage 12, engages the roller chain 9*a* which is suspended parallel to rail 17 by springs 10*a* at each end, and when energized moves the carriage. Sensors 52 send carriage position signals to the controller each time a hole 7 is encountered. Folded loop torsion cable 11a transmits power and signals between the controller and the movable carriage. Security panel 53 is fixed to the rearmost part of the carriage.

The trolley 13 moves laterally, i.e. normal to the rails 17, across the gantry carriage 12 in a similar fashion to the gantry action on the rails 17. Chain 9 is fixed to the gantry carriage by springs 10, and is engaged by a sprocket 15*a* fixed to the motor 15 which pulls the trolley when activated. Sensors 51 signal various trolley positions to the controller. Folded loop cable 16 transmits power and signals between the gantry carriage 12 and the trolley 13. Gripper 49 is fixed to each end of the trolley, with the tapered mouth oriented toward the hanger storage locations defined by notches 2 so the gripper may be opened and moved to engage the hangers, then closed and moved to lift the hangers 4 from the position 2 to a position centered in front of the panel 53.

The gantry carriage is then moved toward the front of the machine until the gripper 49 aligns the hangers for release upon a delivery rod 48. Door 31 is unlocked and opened, and the package is released by the gripper and slides along the rod 48. Customer retrieves parcel **30*a*** which protrudes from the doorway and is illuminated from above.

Figure 6:
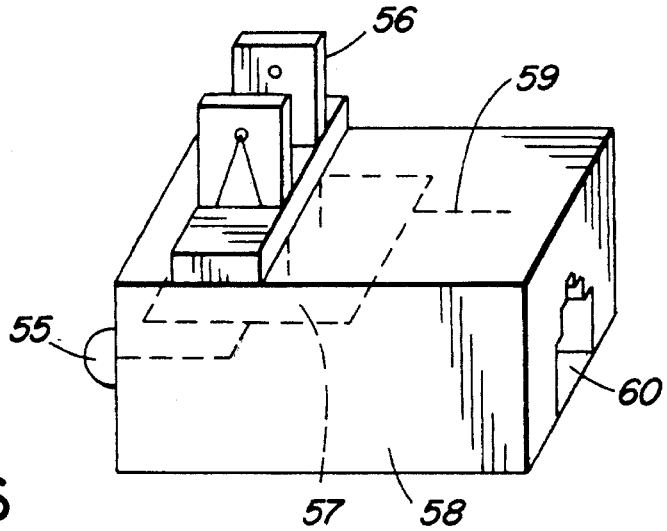
FIG. 6 is a perspective view of a modular sensor.

Finally, referring to FIG. 6 there is modular optical sensors used at various places in the device. A solid state optical slot sensor 56 of a type commonly used in vending machines emits light from one vertical arm and detects that light on the other. Thus the presence of an opaque object between the two vertical arms can be signaled. A small printed circuit board 57 inside the case 58, connects the sensor 56, indicator 55, and other electronic components by the wires 59 to a connector commonly used for telephone cables.

It will be appreciated that the entire operation is controlled by computer software specially written for the purpose. The programs operate the electronic controller, and the database computer (PC) and provide, among other features: communication between the controller and the PC; interpretation of signals at various times from various sensors; operation and coordination of motors, solenoids, relays and the like; communication to and from the self service users using video displays, card readers and the like; sensing, verifying, and storing package, user and location data from various input devices; storing and reporting data including machine status, activity logging, accounting; providing for backup and recovery of data, diagnosis of machine faults, and modification of various data and operational parameters.

A novel special purpose programmable logic micro controller is an integral part of this invention. One embodiment features: two circuits designed to control four low voltage DC servo motors each, simultaneously providing X-Y speed and direction motion control; 7 output relays to actuate electrical devices, 24 input lines to receive signals, eight spare output lines, 24 diagnostic display ports, communication ports; memory and programmable microprocessor; and a means to permanently record the program in read-only non volatile memory. It will be appreciated that other versions may include a larger number of variables.

The PC may be at a remote location, and may service several self-service machines. The system also includes (a) multi user operating system or network software capable of coordinating the support of several machines; (b) a series of programs specifically to receive, store, display, calculate, back up, recover, and report information required to support the operation of several subject machines simultaneously; (c) a programmable controller capable of operating motors by adjusting their speed and direction, actuating devices such as relays and solenoids, sending, receiving and interpreting signals from a multiplicity of sensors, displaying the status of all its functions facilitating direct modification of its read-only program; and communicating with the host PC in two directions; (d) a read only program that supervises the functions of the programmable controller; (e) displays, scanners, keyboards, card readers and other devices well known in the industry; (f) optical sensors which combine a unique circuit board, electronic components, and enclosure to make a novel, easily replaceable sensor component for the invention.

It will also be appreciated by those skilled in the art that, while similar in general concept to the device shown in U.S. Pat. No. 4,717,305, there are several significant and important improvements thereover in the present device. One such important feature is the arrangement and construction of the parallel rails. The offset vee shaped profile of the lower flange along with the notches and shaped holes make it possible to hang several coat hangers directly in one of the multiple positions defined by the slots and oriented in such a way that even misshapen hooks commonly encountered can be readily grasped by the gripper. Each position is identified with a bar coded number. The gripper uses a rotating split ring mechanism to encircle the hanger hook(s). A gripper is attached to each end of a trolley which moves along the gentry carriage to place the active gripper at a pickup point, which then lifts the parcel clear of the rail and moves it to the transfer position. The upper flange of each rail is punched with timing holes aligned with the lower hanger notches so an appropriate sensor fixed to the gentry carriage can signal the carriage location, thus allowing the gripper to be placed in correct alignment to locate the appropriate hanger parcel. Also integral to the upper flange is a track for the gentry wheels. The parallel rails are spaced to allow broadside delivery of the widest expected parcel between the two rows of stored parcels, and also allow easy access inside the machine for the caretaker. Capacity may be doubled by locating a second pair of rails above the first mentioned pair where package size and ceiling clearance allow. This is made possible by the low profile of the gentry carriage, the offset cable arrangement and roller chain drive, all of which leave the access aisle inside the machine clear of obstacles.

A small but important feature of the invention is a practical traveling cable for the transfer of power and signals between fixed and moving parts of the machine. A flexible, flat outer sheath contains the necessary electrical conductors as well as a simple torsion spring wire which provides required body, flex, and direction for the folded loop configuration. While other cable-carrying methods are well known, this one is inexpensive and suited to advantageous placement of the cable.

Significant savings are possible when electrical components use voltages below the limits of regulatory concerns—in component costs, cable thickness and flexibility, and costs of approvals themselves. Gantry carriage and drive mechanisms in this invention are simple, and use safe low voltages. Small DC gear head servo motors are fitted to the gantry and trolley. In each case, a fixed length of roller chain is suspended between springs along the line of travel. A sprocket fixed to the motor shaft engages the chain and pulls the carriage or trolley when the motor is energized. The springs absorb start and stop impacts permitting use of less expensive gear heads, while eliminating tension adjustments.

A self-service device will only be successful if accepted by the users. The invention features a simple and easily understood customer interface. The most practical embodiment uses a visual display and two pushbuttons. When the program requires the customer to make a choice, it is presented visually in such a way that the responses are clearly associated with the pushbuttons. While this is commonly found in touch sensitive visual displays, which could be used by the invention, the abovementioned arrangement is much less costly. The customer may be identified by any electronic means which must also be integrated into the user screen.

The design and construction of the front of the machine is important to customer acceptance, and must also be safe and secure. The drop chute, caretaker access door and user interface each occupy about a third of the overall width of the machine front. The user interface is set back to allow sideways delivery of a garment package through a narrow opening secured by a sliding door. The invention features a unique device to sense obstruction while the sliding door is closing: the controller is then signaled, and the door is reversed to the fully open position, where it waits before attempting to close again. Once a garment is released for customer pickup, it obstructs door closure until removed. If a customer drops a parcel, it is easily retrieved due to the tall, narrow doorway configuration. Persistent obstructions to door or chute closing are reportable to a remote supervisor. The caretaker entrance is a simple door giving access to the central aisle of the machine. Door operation may be sensed in order to relocate internal security panels, or diarize activity, The drop off chute is a simple hinged bucket in a secure baffled enclosure, like a mailbox. Sensors signal bucket open or closed, and count or identify incoming garments or packages as they are received.

The well known barcode method is used in the preferred embodiment to identify each storage position, Garments or packages may be identified with barcode or other electronic means such as radio frequency tags. The caretaker uses a scanner to associate the package with the storage location it occupies. The computer program validates each entry, then stores these relationships for use when retrieving packages for customers. The caretaker is re-prompted when invalid entries are encountered. In other embodiments, the scanning is automated, and performed after replenishment of the machine is complete, or garments are scanned at times of issue and return, or in the most rudimentary embodiment, the garments and locations are key entered by the caretaker. The first-mentioned barcode method is preferred at present because it is cost-effective and accurate.

I claim:

1. A self service apparatus for receiving, storing and dispensing articles in response to signals generated by an authorized user, comprising enclosure means for securely storing said articles and provided with a signal activated drop off access means, caretaker access means signal activated article pick up means, and user activated signally means; drive means to move said pick up access means between a fully closed to a fully open position in response to signals ;generated by said user and including means to sense an obstruction in said pick up access means; first parallel rail means mounted in said enclosure means each provided with a plurality of storage locations at which articles ready for delivery to a user may be suspended in planes normal to the direction of the rails; gantry means mounted for movement along said first parallel rail means; carriage means mounted on said gantry means for movement between opposed said first parallel rails; said gantry means and said carriage means being arranged so that said carriage means may select, pick up and convey a selected article from any selected storage location to said article pick up access means in said plane normal to the direction of the rails in response to a signal generated by said authorized user.

2. An apparatus as claimed in claim 1 whenever each said rail means includes an offset vee bottom flange having notches and holes adapted to receive article storage hangers, and an upper flange having a plurality of timing holes each identifiable by bar code means.

3. An apparatus as claimed in claim 2 wherein said timing holes are uniformly spaced along said rail means.

4. An apparatus as claimed in claim 1 wherein said carriage means is mounted on second parallel rails mounted on said gantry means and includes motor means mounted on said carriage means for driving said carriage means between said first parallel rail means.

5. An apparatus as claimed in claim 4 including spring loaded chain means, mounted between opposed sides of said carriage means, having sprocket means engageable therewith and said motor means to thereby drive said carriage means between said first parallel rails when said motor means is activated in response to an authorized signal.

6. An apparatus as claimed in claim 1 wherein said carriage means includes security panel means dependent therefrom and arranged to permit an authorized user to remove a selected article but block access to said enclosure means when said pick up access means is open.

7. An apparatus as claimed in 6 wherein said carriage means includes gripper means adapted to engage with a support for any selected article.

8. An apparatus as claimed in claim 7 wherein said gripper means includes a wide tapered mouth adapted for self alignment with a selected said article support.

9. An apparatus as claimed in claim 8 wherein said gripper means includes a split ring means rotatable between an open position wherein said gripper means can receive a selected article support and a closed position wherein said gripper means captures and retains a selected article support.

10. An apparatus as claimed in claim 1 wherein said article pick up access means opens in a plane intermediate and parallel said first parallel rail means.

11. An apparatus as claimed in claim 10 wherein said drop off access means, said caretaker access means and said user activated signaling means are arranged in planes perpendicular to said plane of said article pick up access means.

* * * * *